US012514295B2

(12) United States Patent
Forster et al.

(10) Patent No.: US 12,514,295 B2
(45) Date of Patent: Jan. 6, 2026

(54) AEROSOL-GENERATING DEVICE

(71) Applicant: Nicoventures Trading Limited, London (GB)

(72) Inventors: Mark Forster, London (GB); Benjamin Zainuddin, London (GB)

(73) Assignee: Nicoventures Trading Limited, London (GB)

( * ) Notice: Subject to any disclaimer, the term of this patent is extended or adjusted under 35 U.S.C. 154(b) by 705 days.

(21) Appl. No.: 17/793,442

(22) PCT Filed: Jan. 15, 2021

(86) PCT No.: PCT/EP2021/050819

§ 371 (c)(1),
(2) Date: Jul. 18, 2022

(87) PCT Pub. No.: WO2021/144429

PCT Pub. Date: Jul. 22, 2021

(65) Prior Publication Data

US 2023/0098358 A1 Mar. 30, 2023

(30) Foreign Application Priority Data

Jan. 17, 2020 (GB) ..... 2000722

(51) Int. Cl.
*A24F 40/465* (2020.01)
*A24F 40/57* (2020.01)

(52) U.S. Cl.
CPC ..... *A24F 40/465* (2020.01); *A24F 40/57* (2020.01)

(58) Field of Classification Search
CPC ..... A24F 40/57; A24F 40/53; A24F 40/51; A24F 40/50
See application file for complete search history.

(56) References Cited

U.S. PATENT DOCUMENTS

2012/0298123 A1* 11/2012 Woodcock ..... A24D 1/22 131/328
2017/0245550 A1 8/2017 Freelander
2019/0313695 A1* 10/2019 Kaufman ..... A24B 15/167

FOREIGN PATENT DOCUMENTS

EP 3 711 529 A1 9/2020
JP 2019526237 A 9/2019
(Continued)

OTHER PUBLICATIONS

Wang et al. "WO 2019227381 machine translation" published (Year: 2019).*

(Continued)

*Primary Examiner* — Alex B Efta
(74) *Attorney, Agent, or Firm* — Merchant & Gould P.C.

(57) ABSTRACT

Provided herein is an aerosol-generating device for generating aerosol from an aerosol-generating material. The aerosol-generating device comprises a heating assembly including one or more heating units arranged to heat, but not burn, the aerosol-generating material 202 in use and a controller for controlling the one or more heating units. The controller is programmed such that, during a session of use, at least one of the one or more heating units is powered so as to be heated to a plurality of different temperatures sequentially, and each time that the heating unit is heated to a new temperature which is higher than a previous temperature the new temperature is less than 120° C. greater than the previous temperature and the heating unit is held at the new temperature for at least 0.5 seconds.

21 Claims, 4 Drawing Sheets

(56) References Cited

FOREIGN PATENT DOCUMENTS

| | | | | |
|---|---|---|---|---|
| KR | 1020190021439 | | | 3/2019 |
| KR | 1020190024880 | A | | 3/2019 |
| KR | 1020200000467 | A | | 1/2020 |
| WO | WO 2018/019855 | A1 | | 2/2018 |
| WO | WO 2019/186667 | A1 | | 10/2019 |
| WO | 2019227381 | | | 12/2019 |
| WO | WO-2019227381 | A1 | * | 12/2019 |
| WO | WO 2020/182772 | A1 | | 9/2020 |

OTHER PUBLICATIONS

International Search Report and Written Opinion for International Application No. PCT/EP2021/050819, dated May 4, 2021, 13 pages.

"Reasons for Rejection received for Korean Patent Application No. 10-2022-7023268, mailed on Mar. 10, 2025", 14 pages (7 pages of English Translation and 7 pages of Official Copy).

* cited by examiner

AEROSOL-GENERATING DEVICE

The present application is a National Phase entry of PCT Application No. PCT/EP2021/050819, filed Jan. 15, 2021, which claims priority from GB Patent Application No. 2000722.5, filed Jan. 17, 2020, which are hereby fully incorporated herein by reference.

TECHNICAL FIELD

The present disclosure relates to an aerosol-generating device, a method of generating an aerosol using the aerosol-generating device, and an aerosol-generating system comprising the aerosol-generating device.

BACKGROUND

Articles such as cigarettes, cigars and the like burn tobacco during use to create tobacco smoke. Attempts have been made to provide alternatives to these types of articles, which burn tobacco, by creating products that release compounds without burning. Apparatus is known that heats smokable material to volatilise at least one component of the smokable material, typically to form an aerosol which can be inhaled, without burning or combusting the smokable material. Such apparatus is sometimes described as a "heat-not-burn" apparatus or a "tobacco heating product" (THP) or "tobacco heating device" or similar. Various different arrangements for volatilising at least one component of the smokable material are known.

The material may be for example tobacco or other non-tobacco products or a combination, such as a blended mix, which may or may not contain nicotine.

SUMMARY

According to a first aspect of the present disclosure, there is provided an aerosol-generating device for generating aerosol from an aerosol-generating material. The aerosol-generating device comprises a heating assembly, which includes one or more heating units arranged to heat, but not burn, the aerosol-generating material in use, and a controller for controlling the one or more heating units. The controller is programmed such that, during a session of use, at least one of the one or more heating units powered so as to be heated to a plurality of different temperatures sequentially, and each time that the heating unit is heated to a new temperature which is higher than a previous temperature, the new temperature is less than 120° C. greater than the previous temperature, and the heating unit is held at the new temperature for at least 0.5 seconds. In some embodiments, the heating unit is held at the new temperature for at least 1 second, 1.5 seconds, 2 seconds, 3 seconds, 4 seconds, or 5 seconds. In some embodiments, the new temperature is less than 110° C., or 100° C. greater than the previous temperature.

In some embodiments, when the previous temperature is equal to or greater than 80° C., the new temperature is less than 70° C. higher than the previous temperature, or less than 60° C. higher, or less than 55° C. higher.

In some embodiments, the first temperature to which the heating unit is heated and held for at least 0.5 seconds is less than 120° C., less than 110° C., or less than 100° C.

In some embodiments, the plurality of different temperatures includes at least three different temperatures, at least four temperatures, or at least five temperatures.

In some embodiments, the at least three different temperatures includes a first temperature, a second temperature which the heating unit reaches after being held at the first temperature, and a third temperature which the heating unit reaches after being held at the second temperature. In these embodiments, the second temperature is higher than the first temperature. Optionally, the second temperature is less than 60° C. greater than the first temperature.

In some embodiments, the third temperature is higher than the second temperature. Optionally, the third temperature is less than 60° C. greater than the second temperature.

In some embodiments, the first temperature is from 40° C. to 120° C., or 50° C. to 115° C., or 60° C. to 110° C.

In some embodiments, each time the at least one of the one or more heating units is heated to a new temperature, the new temperature is greater than the previous temperature, until the heating unit reaches its maximum operating temperature.

In some embodiments, the one or more heating units includes a first heating unit and a second heating unit. In these embodiments, the at least one of the one or more heating units may include the second heating unit. The heating assembly may be configured such that the second heating unit is heated to a temperature equal to or greater than 80° C., 90° C., or 100° C. but not before 20 seconds from the start of the session of use, or not before 30 seconds from the start of the session of use.

In these embodiments, the heating assembly may be configured such that the first heating unit reaches a temperature of from 200° C. to 300° C., or from 210° C. to 280° C., or 220° C. to 260° C., within 20 seconds of starting a session of use, or within 10 seconds, or within 5 seconds.

In some embodiments, each heating unit in the heating assembly comprises a coil. In these embodiments, each heating unit in the heating assembly may be an induction heating unit comprising a susceptor heating element, wherein the coil is configured to be an inductor element for supplying a varying magnetic field to the susceptor heating element.

In other embodiments, each heating unit in the heating assembly is a resistive heating unit.

In some embodiments, the aerosol-generating device is a tobacco heating product.

According to a second aspect of the present disclosure, there is provided an aerosol-generating device for generating aerosol from an aerosol-generating material. The aerosol-generating device comprises a heating assembly including one or more heating units arranged to heat, but not burn, the aerosol-generating material in use, and a controller for controlling the one or more heating units. The controller is programmed such that, during a session of use, at least one of the one or more heating units is sequentially heated to at least three different temperatures and is held at each of the at least three different temperatures for at least 0.5 seconds.

According to a third aspect of the present disclosure, there is provided an aerosol-generating system comprising an aerosol-generating device according to any of claims 1 to 19 in combination with an aerosol-generating article.

According to a fourth aspect of the present disclosure, there is provided a method of generating aerosol from an aerosol-generating material using an aerosol-generating device according to the first or second aspects. The method includes instructing a heating unit to reach a plurality of different temperatures sequentially, wherein each time a new temperature is higher than a previous temperature, the new temperature is less than 120° C. greater than the previous temperature. It also includes instructing the heating unit to hold each new temperature for at least 0.5 seconds.

Features described herein in relation to one aspect of the disclosure are explicitly disclosed in combination with the other aspects, to the extent that they are compatible.

Further features and advantages of the disclosure will become apparent from the following description of embodiments of the disclosure, given by way of example only, which is made with reference to the accompanying drawings.

DETAILED DESCRIPTION

Figure 1B:
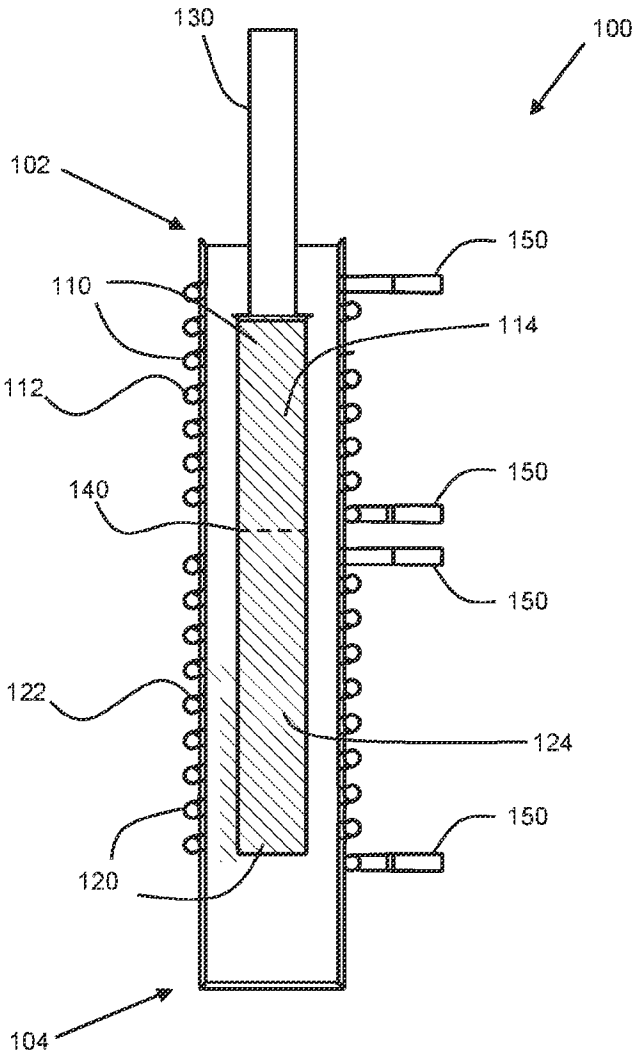
FIG. 1B is a cross-section of the heating assembly shown in FIG. 1A with an aerosol-generating article disposed therein.

As used herein, "the" may be used to mean "the" or "the or each" as appropriate. In particular, features described in relation to "the at least one heating unit" may be applicable to the first, second or further heating units where present. Further, features described in respect of a "first" or "second" integers may be equally applicable integers. For example, features described in respect of a "first" or "second" heating unit may be equally applicable to the other heating units in different embodiments. Similarly, features described in respect of a "first" or "second" mode of operation may be equally applicable to other configured modes of operation.

In general, reference to a "first" heating unit in the heating assembly does not indicate that the heating assembly contains more than one heating unit, unless otherwise specified; rather, the heating assembly comprising a "first" heating unit must simply comprise at least one heating unit. Accordingly, a heating assembly containing only one heating unit expressly falls within the definition of a heating assembly comprising a "first" heating unit.

Similarly, reference to a "first" and "second" heating unit in the heating assembly does not necessarily indicate that the heating assembly contains two heating units only; further heating units may be present. Rather, in this example, the heating assembly must simply comprise at least a first and a second heating unit.

Where reference is made to an event such as reaching a maximum operating temperature occurring "within" a given period, the event may occur at any time between the beginning and the end of the period.

When describing "different temperatures" with respect to a single heating unit, reference is made to the single heating unit passing through different temperatures temporally; one temperature follows another sequentially. This does not refer to a single heating unit having different temperatures in different spatial areas of the heating unit at the same time.

As used herein, the term "aerosol-generating material" includes materials that provide volatilized components upon heating, typically in the form of an aerosol. Aerosol-generating material includes any tobacco-containing material and may, for example, include one or more of tobacco, tobacco derivatives, expanded tobacco, reconstituted tobacco or tobacco substitutes. Aerosol-generating material also may include other, non-tobacco, products, which, depending on the product, may or may not contain nicotine. Aerosol-generating material may for example be in the form of a solid, a liquid, a gel, a wax or the like. Aerosol-generating material may for example also be a combination or a blend of materials. Aerosol-generating material may also be known as "smokable material". In an embodiment, the aerosol-generating material is a non-liquid aerosol-generating material. In a particular embodiment, the non-liquid aerosol-generating material comprises tobacco.

Apparatus is known that heats aerosol-generating material to volatilize at least one component of the aerosol-generating material, typically to form an aerosol which can be inhaled, without burning or combusting the aerosol-generating material. Such apparatus is sometimes described as an "aerosol-generating device", an "aerosol provision device", a "heat-not-burn device", a "tobacco heating product", a "tobacco heating product device", a "tobacco heating device" or similar. In an embodiment of the present disclosure, the aerosol-generating device of the present disclosure is a tobacco heating product. The non-liquid aerosol-generating material for use with a tobacco heating product comprises tobacco.

Similarly, there are also so-called e-cigarette devices, which are typically aerosol-generating devices which vaporize an aerosol-generating material in the form of a liquid, which may or may not contain nicotine. The aerosol-generating material may be in the form of or be provided as part of a rod, cartridge or cassette or the like which can be inserted into the apparatus. A heater for heating and volatilising the aerosol-generating material may be provided as a "permanent" part of the apparatus.

An aerosol-generating device can receive an article comprising aerosol-generating material for heating, also referred to as a "smoking article". An "article", "aerosol-generating article" or "smoking article" in this context is a component that includes or contains in use the aerosol-generating material, which is heated to volatilize the aerosol-generating material, and optionally other components in use. A user may insert the article into the aerosol-generating device before it is heated to produce an aerosol, which the user subsequently inhales. The article may be, for example, of a predetermined or specific size that is configured to be placed within a heating chamber of the device which is sized to receive the article.

The aerosol-generating device of the present disclosure comprises a heating assembly. The heating assembly comprises one or more heating units, each heating unit being arranged to heat, but not burn, the aerosol-generating material in use.

A heating unit typically refers to a component which is arranged to receive electrical energy from an electrical energy source, and to supply thermal energy to an aerosol-generating material. A heating unit comprises a heating element. A heating element is typically a material which is arranged to supply heat to an aerosol-generating material in use. The heating unit comprising the heating element may comprise any other component required, such as a component for transducing the electrical energy received by the heating unit. In other examples, the heating element itself may be configured to transduce electrical energy to thermal energy.

The heating unit may comprise a coil. In some examples, the coil is configured to, in use, cause heating of at least one electrically-conductive heating element, so that heat energy is conductible from the at least one electrically-conductive heating element to aerosol generating material to thereby cause heating of the aerosol generating material.

In some examples, the coil is configured to generate, in use, a varying magnetic field for penetrating at least one heating element, to thereby cause induction heating and/or magnetic hysteresis heating of the at least one heating element. In such an arrangement, the or each heating element may be termed a "susceptor". A coil that is configured to generate, in use, a varying magnetic field for penetrating at least one electrically-conductive heating element, to thereby cause induction heating of the at least one electrically-conductive heating element, may be termed an "induction coil" or "inductor coil".

The device may include the heating element(s), for example electrically-conductive heating element(s), and the heating element(s) may be suitably located or locatable relative to the coil to enable such heating of the heating element(s). The heating element(s) may be in a fixed position relative to the coil. Alternatively, the at least one heating element, for example at least one electrically-conductive heating element, may be included in an article for insertion into a heating zone of the device, wherein the article also comprises the aerosol generating material and is removable from the heating zone after use. Alternatively, both the device and such an article may comprise at least one respective heating element, for example at least one electrically-conductive heating element, and the coil may be to cause heating of the heating element(s) of each of the device and the article when the article is in the heating zone.

In some examples, the coil is helical. In some examples, the coil encircles at least a part of a heating zone of the device that is configured to receive aerosol generating material. In some examples, the coil is a helical coil that encircles at least a part of the heating zone.

In some examples, the device comprises an electrically-conductive heating element that at least partially surrounds the heating zone, and the coil is a helical coil that encircles at least a part of the electrically-conductive heating element. In some examples, the electrically-conductive heating element is tubular. In some examples, the coil is an inductor coil.

In some examples, the heating unit is an induction heating unit. Surprisingly, it has been found by the inventors that induction heating units in an aerosol-generating device reach a maximum operating temperature much more rapidly than corresponding resistive heating elements. In an embodiment, the heating assembly is configured such that the first induction heating unit reaches its maximum operating temperature at a rate of at least 100° C. per second. In a particular embodiment, the heating assembly is configured such that the first induction heating unit reaches the maximum operating temperature at a rate of at least 150° C. per second.

Induction heating systems may also be advantageous because the varying magnetic field magnitude can be easily controlled by controlling power supplied to the heating unit. Moreover, as induction heating does not require a physical connection to be provided between the source of the varying magnetic field and the heat source, design freedom and control over the heating profile may be greater, and cost may be lower.

In other examples, the heating unit is a resistive heating unit. A resistive heating unit may consist of a resistive heating element. That is, it may be unnecessary for a resistive heating unit to include a separate component for transducing the electrical energy received by the heating unit, because a resistive heating element itself transduces electrical energy to thermal energy.

Using electrical resistance heating systems may be advantageous because the rate of heat generation is easier to control, and lower levels of heat are easier to generate, compared with using combustion for heat generation. The use of electrical heating systems therefore allows greater control over the generation of an aerosol from a tobacco composition.

Reference is made to the temperature of heating elements throughout the present specification. The temperature of a heating element may also be conveniently referred to as the temperature of the heating unit which comprises the heating element. This does not necessarily mean that the entire heating unit is at the given temperature. For example, where reference is made to the temperature of an induction heating unit, it does not necessarily mean that the both the inductive element and the susceptor have such a temperature. Rather, in this example, the temperature of the induction heating unit corresponds to the temperature of the heating element composed in the induction heating unit. For the avoidance of doubt, the temperature of a heating element and the temperature of a heating unit can be used interchangeably.

As used herein, "temperature profile" refers to the variation of temperature of a material over time. For example, the varying temperature of a heating element measured at the heating element for the duration of a smoking session may be referred to as the temperature profile of that heating element. The heating elements provide heat to the aerosol-generating material during use, to generate an aerosol. The temperature profile of the heating element therefore induces the temperature profile of aerosol-generating material disposed near the heating element.

In the aerosol-generating device of the present disclosure, each heating element in the heating assembly is arranged to heat, but not burn, aerosol-generating material. Although the temperature profile of each heating element induces the temperature profile of each associated portion of aerosol-generating material, the temperature profiles of the heating element and the associated portion of aerosol-generating material may not exactly correspond. For example: there may be "bleed" in the form of conduction, convection and/or radiation of heat energy from one portion of the aerosol-generating material to another; there may be variations in conduction, convection and/or radiation of heat energy from the heating elements to the aerosol-generating material; there may be a lag between the change in the temperature profile of the heating element and the change in the temperature profile of the aerosol-generating material, depending on the heat capacity of the aerosol-generating material.

The heating assembly also comprises a controller for controlling each heating unit present in the heating assembly. The controller may be a PCB. The controller is configured to control the power supplied to each heating unit, and controls the "programmed heating profile" of each heating unit present in the heating assembly. For example, the controller may be programmed to control the current supplied to a plurality of inductors to control the resulting temperature profiles of the corresponding induction heating elements. As between the temperature profile of heating elements and aerosol-generating material described above, the programmed heating profile of a heating element may not exactly correspond to the observed temperature profile of a heating element, for the same reasons given above. The temperature to which the controller is programmed to heat a heating unit may be referred to as the "programmed temperature".

In some embodiments, the device comprises one or more temperature sensors to detect the heat of one or more heating elements disposed in the heating assembly. Suitable temperature sensors include thermocouples, thermopiles or resistance temperature detectors (RTDs, also referred to as resistance thermometers). In a particular embodiment, the device comprises at least one RTD. In one embodiment, the device comprises thermocouples arranged on each heating element present in the aerosol-generating device. The temperature data measured by the or each temperature sensor may be communicated to the controller. Further, it may be communicated to the controller when a heating element has reached a prescribed temperature, such that the controller may change the supply of power to elements within the aerosol-generating device accordingly. The controller may comprise a PID controller, which uses a control loop feedback mechanism to control the temperature of the heating elements based on data supplied from one or more temperature sensors disposed in the device. In an embodiment, the controller comprises a PID controller configured to control the temperature of each heating element based on temperature data supplied from thermocouples disposed at each of the heating elements.

As used herein, "puff" refers to a single inhalation by the user of the aerosol generated by the aerosol-generating device.

In use, the device of the present disclosure heats an aerosol-generating material to provide an inhalable aerosol. The device may be referred to as "ready for use" when at least a portion of the aerosol-generating material has reached a lowest operating temperature and a user can take a puff which contains a satisfactory amount of aerosol. In some embodiments the device may be ready for use within approximately 20 seconds of supplying power to the first heating unit, or 15 seconds, or 10 seconds. The device may be ready for use within approximately 20 seconds of activation of the device, or 15 seconds, or 10 seconds. The device may begin supplying power to a heating unit such as the first heating unit when the device is activated, or it may begin supplying power to the heating unit after the device is activated. The device may be configured such that power starts being supplied to the first heating unit some time after activation of the device, such as at least 1 second, 2 seconds or 3 seconds after activation of the device. The device may be configured such that power is not supplied to the first heating unit, or any heating unit present in the heating assembly until at least 2.5 seconds after activation of the device. This may advantageously prolong battery life by avoiding unintentional activation of the heating unit(s).

The aerosol-generating device of the present disclosure may be ready for use more quickly than corresponding aerosol-generating devices known in the art, providing an improved user experience. Generally, the point at which the device is ready for use will be some time after the first heating unit has reached its maximum operating temperature, as it will take some amount of time to transfer sufficient thermal energy from the heating unit to the aerosol-generating material in order to generate the aerosol. The device may be ready for use within 20 seconds of the first heating unit reaching its maximum operating temperature, or 15 seconds, or 10 seconds.

Further, surprisingly it has been found that characteristics of the aerosol generated from the aerosol-generating material may depend on the rate at which the aerosol-generating material is heated. For example, the aerosol generated from an aerosol-generating material which is subject to heating from a heating unit which is configured to change temperature quickly may provide an improved user experience. In one embodiment wherein the aerosol-generating material comprises menthol, it has been found that rapidly increasing the temperature of the heating unit may increase the rate at which menthol is delivered to a user in the aerosol, and thereby reduce the amount of menthol component that is wasted (i.e. does not form part of the aerosol inhaled by a user) from static heating.

In some embodiments, the user's sensorial experience arising from the aerosol generated by the present device is like that of smoking a combustible cigarette, such as a factory-made cigarette.

The device may indicate that it is ready for use via an indicator. In an embodiment, the device may be configured such that the indicator indicates that the device is ready for use within approximately 20 seconds of power being supplied to the first heating unit, or 15 seconds, or 10 seconds. In a particular embodiment, the device is configured such that the indicator indicates that the device is ready for use within approximately 20 seconds of activation of the device, or 15 seconds, or 10 seconds. In another embodiment, the device is configured such that the indicator indicates that the device is ready for use within approximately 20 seconds of the first heating unit reaching its maximum operating temperature, or 15 seconds, or 10 seconds.

"Session of use" as used herein refers to a single period of use of the aerosol-generating device by a user. The session of use begins at the point at which power is first supplied to at least one heating unit present in the heating assembly. The device will be ready for use after a period of time has elapsed from the start of the session of use. The session of use ends at the point at which no power is supplied to any of the heating units in the aerosol-generating device. The end of the session of use may coincide with the point at which the aerosol-generating article is depleted (the point at which the total particulate matter yield (mg) in each puff would be deemed unacceptably low by a user). The session will have a duration of a plurality of puffs. Said session may have a duration less than 7 minutes, or 6 minutes, or 5 minutes, or 4 minutes and 30 seconds, or 4 minutes, or 3 minutes and 30 seconds. In some embodiments, the session of use may have a duration of from 2 to 5 minutes, or from 3 to 4.5 minutes, or 3.5 to 4.5 minutes, or suitably 4 minutes. A session may be initiated by the user actuating a button or switch on the device, causing at least one heating unit to begin rising in temperature when activated or some time after activation.

The device will be ready for use after a period of time has elapsed from the start of the session of use. The device may include an indicator for indicating when the user should begin inhaling aerosol from the device. "Inhalation session" as used herein refers to the period which begins at the point at which the device is ready for use and/or the point at which the indicator indicates to the user that the device is ready for use, and ends at the end of the session of use. The inhalation session will inherently have a duration shorter than the total session of use. "Indicated inhalation session" refers to an inhalation session wherein the starting point is defined as the point at which an indicator indicates to the user that the device is ready for use. "Operating temperature inhalation session" refers to an inhalation session wherein the starting point is defined as the point at which at least a portion of the aerosol-generating material has reached a lowest operating temperature and a user can take a puff which contains a satisfactory amount of aerosol. The indicated inhalation session may or may not be the same as the operating temperature inhalation session. For the avoidance of doubt, the general term "inhalation session" includes both of these session definitions. References to the inhalation session herein can be taken to refer to either the indicated inhalation session or the operating temperature inhalation session, unless otherwise indicated.

"Operating temperature" as used herein in relation to a heating element refers to any heating element temperature at which the element can heat an aerosol-generating material to produce sufficient aerosol for a satisfactory puff without burning the aerosol-generating material. The maximum operating temperature of a heating element is the highest temperature reached by the element during a smoking session. The lowest operating temperature of the heating element refers to the lowest heating element temperature at which sufficient aerosol can be generated from the aerosol-generating material by the heating element for a satisfactory puff. Where there is a plurality of heating elements present in the aerosol-generating device, each heating element has an associated maximum operating temperature. The maximum operating temperature of each heating element may be the same, or it may differ for each heating element.

The heating assembly of the present disclosure may be configured such that at least one heating unit, such as the first heating unit, reaches a maximum operating temperature of from 200° C. to 340° C. in use.

In some embodiments, the maximum operating temperature is from approximately 200° C. to 300° C., or 210° C. to 290° C., from 220° C. to 280° C., or 230° C. to 270° C.

In some embodiments, the maximum operating temperature is from approximately 245° C. to 340° C., or 245° C. to 300° C., or from 250° C. to 280° C.

In some embodiments, the maximum operating temperature is less than approximately 340° C., 330° C., 320° C., 310° C., 300° C., or 290° C., or 280° C., or 270° C., or 260° C., or 250° C.

The term "operating temperature" can also be used in relation to the aerosol-generating material. In this case, the term refers to any temperature of the aerosol-generating material itself at which sufficient aerosol is generated from the aerosol-generating material for a satisfactory puff. The maximum operating temperature of the aerosol-generating material is the highest temperature reached by any part of the aerosol-generating material during a smoking session. In some embodiments, the maximum operating temperature of the aerosol-generating material is greater than 200° C., 210° C., 220° C., 230° C., 240° C., 250° C., 260° C., or 270° C. In some embodiments, the maximum operating temperature of the aerosol-generating material is less than 300° C., 290° C., 280° C., 270° C., 260° C., 250° C., or 240° C. The lowest operating temperature is the lowest temperature of aerosol-generating material at which sufficient aerosol is generated from the material to product sufficient aerosol for a satisfactory "puff". In some embodiments, the lowest operating temperature of the aerosol-generating material is greater than 90° C., 100° C., 110° C., 120° C., 130° C., 140° C. or 150° C. In some embodiments, the lowest operating temperature of the aerosol-generating material is less than 150° C., 140° C., 130° C., or 120° C.

The heating assembly is configured to operate as described herein. The device of the present disclosure may at least partially be configured to operate in this manner by the controller of the heating assembly being programmed to operate the device in the plurality of modes. Accordingly, references herein to the configuration of the device of the present disclosure or components thereof may refer to the controller of the heating assembly being programmed to operate the device as disclosed herein, amongst other features (such as spatial arrangement of the components in the heating assembly).

Aerosol-generating articles for aerosol-generating devices (such as tobacco heating products) usually contain more water and/or aerosol-generating agent than combustible smoking articles to facilitate formation of an aerosol in use. This higher water and/or aerosol-generating agent content can increase the risk of condensate collecting within the aerosol-generating device during use, particularly in locations away from the heating unit(s). This problem may be greater in devices with enclosed heating chambers, and particularly those with external heaters, than those provided with internal heaters (such as "blade" heaters). Without wishing to be bound by theory, it is believed that since a greater proportion/surface area of the aerosol-generating material is heated by external-heating heating assemblies, more aerosol is released than a device which heats the aerosol-generating material internally, leading to more condensation of the aerosol within the device. An object of the present disclosure is to reduce the amount of condensation which accumulates within such a device.

The inventors have found that programmed heating profiles of the present disclosure may advantageously be employed in a device configured to externally heat aerosol-generating material to provide a desirable amount of aerosol to the user whilst keeping the amount of aerosol which condenses inside the device low. In particular, configuring the programmed heating profile of at least one heating unit to heat the substrate in a series of "steps" may help to reduce the amount of condensation which is retained within the device. Further, the maximum operating temperature of a heating unit may affect the amount of condensate formed—it may be that lower maximum operating temperatures provide less undesirable condensate. The difference between maximum operating temperatures of heating units in a heating assembly may also affect the amount of condensate formed. Further, the point in a session of use at which each heating unit present in the heating assembly reaches its maximum operating temperature may affect the amount of condensate formed.

According to one aspect of the present disclosure, the controller is programmed such that, during a session of use, at least one of the one or more heating units is heated to a plurality of different temperatures sequentially, and each time that the heating unit is heated to a new temperature which is higher than a previous temperature, the new temperature is less than 130° C. greater than the previous temperature, and the heating unit is held at the new temperature for at least 0.5 seconds. As used herein, the heating unit being "held" at the new temperature means that the heating unit has a measured temperature for at least 0.5 seconds within 15%, 10%, 5%, 2%, 1%, or 0.1% of the given temperature.

In some embodiments, the new temperature is less than 120° C., 110° C., 100° C., 90° C., 80° C., 70° C. or 60° C. greater than the previous temperature.

In some embodiments, the heating unit is held at the new temperature for at least 1 second, 1.5 seconds, 2 seconds, 3 seconds, 4 seconds, or 5 seconds. As used herein, "holding" a heating unit at a given temperature for a given duration means that the controller is programmed to supply power to the heating unit such that it has a constant programmed temperature throughout that duration. The period during which a heating unit is held at a constant programmed temperature may conveniently be referred to as "dwell time". A change in temperature followed by a dwell time may be referred to as a "step".

A small temperature change followed by dwell time at the new temperature may help to reduce the amount of condensation which collects in the device. In particular, a series of small temperature increases followed by dwell times at each new temperature may produce less undesirable condensation than a single temperature increase of the same overall magnitude. Without wishing to be bound by theory, it is believed that this "stepwise" approach extends the condensate generation over a longer period of time, thus permitting its removal by a user drawing on the device. Conversely, large, sudden temperature increases may provide a large amount of condensation in a short period of time, to the extent that there is far more condensation than a user is able to inhale over such a period.

In some embodiments, when the previous temperature is equal to or greater than 80° C., the new temperature is less than 70° C. higher than the previous temperature, or less than 60° C. higher, or less than 55° C. higher. In a particular embodiment, when the previous temperature is equal to or greater than 80° C., the new temperature is less than 55° C. higher. Smaller temperature changes at higher temperatures may help to reduce unwanted condensation.

In some embodiments, two temperatures of the programmed heating profile may differ by less than 50° C., 40° C., 30° C., 20° C., or 10° C.

In some embodiments, the first temperature to which the heating unit is heated and held for at least 0.5 seconds is less than 120° C., less than 110° C., or less than 100° C. In some embodiments, the first temperature is greater than 40° C., 50° C., 60° C., 70° C., 80° C., or 90° C. In some embodiments, the first temperature is from 40° C. to 120° C., or from 50° C. to 115° C., or 60° C. to 110° C., or 70° C. to 105° C. Without wishing to be bound by theory, it is believed that a high first temperature, such as higher than 120° C., may generate a large amount of undesirable condensation in a short period of time, partly due to the rapid volatilisation of water in the substrate.

As described above, more gradual heating may help to reduce undesirable condensation. In a particular embodiment, each new temperature which the heating unit is heated to is higher than the previous temperature, until the heating unit reaches its maximum operating temperature. This may be conveniently referred to as a "stepwise ramp-up".

According to another aspect of the disclosure, the controller is programmed such that, during a session of use, at least one of the one or more heating units is sequentially heated to at least three different temperatures and is held at each of the at least three different temperatures for at least 0.5 seconds. For the avoidance of doubt, the three different temperatures referred to follow each other temporally (that is, sequentially). This does not refer to a heating unit being heated to three different temperatures at different spatial areas of the heating unit.

In some embodiments, the heating unit may be heated to more than three different temperatures, such as four different temperatures, five different temperatures, or more than five different temperatures, and held at each for at least 0.5 seconds. A greater number of different temperatures may lead to a more gradual ramp-up and thereby providing less undesirable condensate.

The programmed profile may include a first temperature, a second temperature, a third temperature, a fourth temperature, a fifth temperature, and so on. In some embodiments, each temperature is higher than the temperature which preceded it. For example, the second temperature is higher than the first temperature; the third temperature is higher than the second temperature.

The differences between these temperatures may be relatively small. The difference between at least some or all of the temperatures may be less than 60° C., 55° C., or 50° C.

The heating assembly may be operable in a plurality of modes, such as a first mode and a second mode. The heating assembly may be operable in a maximum of two modes, or may be operable in more than two modes, such as three modes, four modes, or five modes. Each mode may be associated with a predetermined heating profile for each heating unit in the heating assembly, such as a programmed heating profile. One or more of the programmed heating profiles may be programmed by a user. Additionally, or alternatively, one or more of the programmed heating profiles may be programmed by the manufacturer. In these examples, the one or more programmed heating profiles may be fixed such that an end user cannot alter the one or more programmed heating profiles.

Each mode of operation is associated with a predetermined duration for a session of use. At least some modes of operation are associated with predetermined durations which differ from each other. For example, where the heating assembly is operable in a first mode and a second mode, the duration associated with the first mode (the first predetermined duration of the first-mode session of use) differs from the duration associated with the second mode (the second predetermined duration of the second-mode session of use). The first predetermined duration of the first-mode session of use may be longer or shorter than the second predetermined duration of the second-mode session of use. The first predetermined duration of the first-mode session of use may be longer than the second predetermined duration of the second-mode session of use.

Providing an aerosol-generating device such as a tobacco heating product with a heating assembly that is operable in a plurality of modes advantageously gives more choice to the consumer, particularly where each mode is associated with a different duration of session of use. Moreover, such a device is capable of providing different aerosols having differing characteristics, because volatile components in the aerosol-generating material will be volatilized at different rates and concentrations over different session lengths. This may allow a user to select a particular mode based on a desired characteristic of the inhalable aerosol, such as degree of tobacco flavor, nicotine concentration, and aerosol temperature. For example, modes in which the session of use has a relatively short duration may be configured to provide a quicker first puff, or a greater nicotine content per puff, or a more concentrated flavor per puff. Conversely, modes in which the or each heating unit rises to a lower temperature may be configured to provide a lower nicotine content per puff, or more sustained delivery of flavor.

Each mode may also be associated with a maximum temperature to which the or each heating unit in the heating assembly rises in use. The heating assembly may be configured such that each heating unit reaches a first-mode maximum operating temperature in the first mode, and a second-mode maximum operating temperature in the second mode. The maximum operating temperature of at least one heating unit of the heating assembly in the first mode may differ from the maximum operating temperature of that heating unit in the second mode. For example, the maximum operating temperature of the first heating unit in the first mode (herein referred to as the "first-mode maximum operating temperature" of the first heating unit) may differ from the maximum operating temperature of the first heating unit in the second mode (herein referred to as the "second-mode maximum operating temperature" of the first heating unit). In some examples, the first mode maximum operating temperature is higher than the second-mode maximum operating temperature; in other examples, the first-mode maximum operating temperature is lower than the second-mode maximum operating temperature. The second-mode maximum operating temperature of the first heating unit may be higher than the first-mode maximum operating temperature of the first heating unit.

In embodiments wherein the or each heating unit rises to a higher temperature in the second mode, the second mode may be referred to as a "boost" mode. For the first time, aspects of the present disclosure provide an aerosol-generating device which is operable in a first "normal" mode, and a second "boost" mode. The "boost" mode may advantageously provide a quicker first puff, or a greater nicotine content per puff, or a more concentrated flavor per puff. In an embodiment, the heating assembly is configured such that the second mode is associated with a shorter duration of session of use and a higher maximum operating temperature. This may allow for delivery of consistent amounts of volatile components to a user over a session of use—a hotter maximum operating temperature may result in quicker depletion of the volatile components from the aerosol-generating material, so a shorter duration of session of use is preferable.

The first session of use duration maybe longer than the second session of use duration. In some examples, the first and/or second session of use may have a duration of at least 2 minutes, 2 minutes 30 seconds, 3 minutes, 3 minutes 30 seconds, 4 minutes, 4 minutes 30 seconds, 5 minutes, 5 minutes 30 seconds, or 6 minutes. In some examples, the first and/or second session of use may have a duration of less than 7 minutes, 6 minutes, 5 minutes 30 seconds, 5 minutes, 4 minutes 30 seconds, or 4 minutes. The first session of use may have a duration of from 3 minutes to 5 minutes, or from 3 minutes 30 seconds to 4 minutes 30 seconds. The second session of use may have a duration of from 2 minutes to 4 minutes, or from 2 minutes 30 seconds to 3 minutes 30 seconds.

Each mode of operation is also associated with a predetermined duration for the inhalation session in each mode. The first inhalation session duration may be longer than the second inhalation session duration. In some examples, the first and/or second inhalation session may have a duration of at least 2 minutes, 2 minutes 30 seconds, 3 minutes, 3 minutes 30 seconds, 4 minutes, 4 minutes 30 seconds, 5 minutes, 5 minutes 30 seconds, or 6 minutes. In some examples, the first and/or second inhalation session may have a duration of less than 7 minutes, 6 minutes, 5 minutes 30 seconds, 5 minutes, 4 minutes 30 seconds, or 4 minutes. The first inhalation session may have a duration of from 3 minutes to 5 minutes, or from 3 minutes 30 seconds to 4 minutes 30 seconds. The second inhalation session may have a duration of from 2 minutes to 4 minutes, or from 2 minutes 30 seconds to 3 minutes 30 seconds.

The time taken for the device to be ready for use may differ between modes of operation. For example, in embodiments wherein the second mode has a higher maximum operating temperature, the device may be ready for use at an earlier point in a session of use than in the first mode. In an embodiment, the device is configured such that the device is ready for use quicker when operated in the second mode than in the first mode.

In a particular embodiment, the device comprises an indicator and is configured to indicate to the user when the device is ready for use. In one embodiment, the device is configured such that the point of the session of use at which the indicator indicates to the user that the device is ready for use differs between at least two modes. The device may be configured such that the point at which the indicator indicates to the user is earlier in the second mode than in the first mode. For example, the device may indicate to the user that they should begin inhaling aerosol from the device approximately 20 seconds from the start of the session of use in the first mode, but approximately 10 seconds from the start of the session of use in the second mode.

In some embodiments, the heating assembly comprises a plurality of heating units. For example, the heating assembly may comprise two heating units: a first heating unit described above, and a second heating unit. The second heating unit is arranged to heat, but not burn, the aerosol-generating material in use. The second heating unit is controllable by the controller of the heating assembly. The second heating unit is controllable independent from the first heating unit.

The heating assembly may comprise a maximum of two heating units. In other examples, the heating assembly comprises more than two independently controllable heating units, such as three, four or five independently controllable heating units.

In these embodiments, one or more of the heating units may be programmed to have a stepwise programmed heating profile as described hereinabove. In a particular embodiment, the heating assembly comprises a first heating unit and a second heating unit, wherein the second heating unit has a stepwise programmed heating profile as described hereinabove.

In some embodiments, the first heating unit is supplied with power at the start of the session. For example, the heating assembly may be configured such that the first heating unit reaches a temperature of from 200° C. to 300° C., or from 210° C. to 280° C., or 220° C. to 260° C., within 20 seconds of starting a session of use, or within 10 seconds, or within 5 seconds.

In embodiments, at least one of the heating units provided in the heating assembly is supplied with power for the entire session of use in at least one mode. In particular, the first heating unit may be supplied with power for the entire first-mode session of use and/or second-mode session of use. In a particular embodiment, the first heating unit is supplied with power for the entire session of use in each mode of operation of the device.

In embodiments, at least one of the heating units provided in the heating assembly is supplied with power for less than the entire session of use in at least one mode. This may advantageously allow for more economical power use while maintaining an acceptable aerosol to be delivered to the user. In particular, the second heating unit may be supplied with power for less than the entire first-mode session of use and/or second-mode session of use. In a particular embodiment, the second heating unit is supplied with power for less than the entire session of use in each mode of operation of the device. The second heating unit may be supplied with power for at least half the session of use in each mode, but less than the entire session of use in each mode.

In some embodiments, power is first supplied to the second heating unit after at least 10 seconds, 115 seconds, 20 seconds, 25 seconds, 30 seconds, 35 seconds, 40 seconds, 50 seconds, or 60 seconds have elapsed after the start of the session of use. A later start time and stepwise programmed heating profile may help the second heater to "fade in" to the session, and reduce of undesirable condensate produces by, for example, extending the period over which condensate is produced.

In some embodiments, the heating assembly comprises at least a first heating unit and a second heating unit, and the heating assembly is operable in a first mode and a second mode. In this embodiment, the first mode of operation may comprise supplying energy to the first heating unit for a first-mode predetermined duration; and the second mode may comprise supplying energy to the first heating unit for a second-mode predetermined duration. The first mode may also comprise supplying energy to the second heating unit for a first-mode predetermined duration; and the second mode may also comprise supplying energy to the second heating unit for a second-mode predetermined duration.

In some embodiments, the predetermined duration of at least one heating unit is the same in each mode. In some embodiments, the predetermined duration of at least one heating unit differs between modes. In an embodiment, the predetermined duration of supplying energy to each heating unit differs between each mode.

It is expressly contemplated that a heating assembly configured to operate in at least two modes having different durations of session of use may be configured such that at least one heating unit in the assembly is supplied with energy for the same amount of time in both modes. For example, the assembly may be configured to provide a first-mode inhalation session lasting 4 minutes, and a second-mode inhalation session lasting 3 minutes. In this example, if the assembly included two heating units, the first heating unit may be supplied with energy for the entirety of each session of use. The second heating unit may be supplied with energy only for the last minute of each session of use. Accordingly, in this embodiment, even though the first-mode session of use has a different duration from the second-mode session of use, the assembly is configured such that power is supplied to the second heating unit for the same amount of time in both modes.

In some embodiments, the first-mode predetermined duration of supplying energy to the first heating unit is from approximately 3 minutes to 5 minutes, or from 3 minutes 30 seconds to 4 minutes 30 seconds. This first-mode predetermined duration may be less than 4 minutes 30 seconds, 4 minutes, or 3 minutes 30 seconds. This first-mode predetermined duration may be greater than 3 minutes, 3 minutes 30 seconds, or 4 minutes.

In some embodiments, the first-mode predetermined duration of supplying energy to the second heating unit is from approximately 2 minutes to 4 minutes, or from 2 minutes 30 seconds to 3 minutes 30 seconds. This first-mode predetermined duration may be less than 4 minutes, 3 minutes 30 seconds, or 3 minutes. This first-mode predetermined duration may be greater than 2 minutes, 2 minutes 30 seconds, or 3 minutes.

In some embodiments, the second-mode predetermined duration of supplying energy to the first heating unit is from approximately 2 minutes to 4 minutes, from 2 minutes 30 seconds to 3 minutes 30 seconds, or approximately 3 minutes. This second-mode predetermined duration may be less than 4 minutes, or 3 minutes 30 seconds. This first-mode predetermined duration may be greater than 2 minutes, or 2 minutes 30 seconds.

In some embodiments, the second-mode predetermined duration of supplying energy to the second heating unit is from approximately 1 minute 30 seconds to 3 minutes, from 2 minutes to 3 minutes, or from approximately 2 minutes 30 seconds. This second-mode predetermined duration may be less than 3 minutes, or 2 minutes 30 seconds. This first-mode predetermined duration may be greater than 1 minute 90 seconds, 2 minutes, or 2 minutes 30 seconds.

The heating assembly may be configured such that each heating unit present in the heating assembly reaches a first-mode maximum operating temperature in the first mode, and a second-mode maximum operating temperature in the second mode. For example, the second heating unit may reach a first-mode maximum operating temperature in the first mode, and a second-mode maximum operating temperature in the second mode. The maximum operating temperature of each heating unit in each mode may be the same, or may be different. For example, the maximum operating temperature of the second heating unit in each mode may or may not be the same as the maximum operating temperature of the first heating unit in each mode.

The first-mode maximum operating temperature of the first heating unit may differ from the second-mode maximum operating temperature of the first heating unit. For example, the first-mode maximum operating temperature may be higher than the second-mode maximum operating temperature; alternatively, the first-mode maximum operating temperature may be lower than the second-mode maximum operating temperature. The second-mode maximum operating temperature of the first heating unit may be higher than the first-mode maximum operating temperature of the first heating unit.

The first-mode maximum operating temperature of the second heating unit may differ from the second-mode maximum operating temperature of the second heating unit. For example, the first-mode maximum operating temperature may be higher than the second-mode maximum operating temperature; alternatively, the first-mode maximum operating temperature may be lower than the second-mode maximum operating temperature. The second-mode maximum operating temperature of the second heating unit may be higher than the first-mode maximum operating temperature of the second heating unit.

In some embodiments, each heating unit of the heating assembly has a higher maximum operating temperature in the second mode than in the first mode.

As mentioned above, the maximum operating temperatures of the first heating unit may or may not be the same as those of the second heating unit. In one embodiment, the first-mode maximum operating temperature of the first heating unit is substantially the same as the first-mode maximum operating temperature of the second heating unit. In another embodiment, the first-mode maximum operating temperature of the first heating unit differs from the first-mode maximum operating temperature of the second unit. For example, the first-mode maximum operating temperature of the first heating unit may be higher than the first-mode maximum operating temperature of the second heating unit, or the first-mode maximum operating temperature of the first heating unit may be lower than the first-mode maximum operating temperature of the second heating unit. The first-mode maximum operating temperature of the first heating unit may be substantially the same as the first-mode maximum operating temperature of the second heating unit. The inventors have found that configuring the heating assembly such that the first-mode maximum operating temperature of the first heating unit is substantially the same as the first-mode maximum operating temperature of the second heating unit may reduce the amount of condensate which collects within the device during use, while still providing an acceptable puff to the user.

In some examples, the first-mode maximum operating temperature of the first heating unit and/or the second heating unit is less than 300° C., 290° C., 280° C., 270° C., 260° C., 250° C., or 240° C. In some examples, the first-mode maximum operating temperature of the first heating unit and/or the second heating unit is greater than 220° C., 230° C., 240° C., 245° C., 250° C., 255° C., 260° C., 265° C., or 270° C. In some examples, the first-mode maximum operating temperature of the first heating unit and/or the second heating unit is from 240° C. to 300° C., or 240° C. to 280° C., or 245° C. to 270° C. In one embodiment, the first-mode maximum operating temperature of the first heating unit and the first-mode maximum operating temperature of the second heating unit is from 245° C. to 270° C. In another embodiment, the first-mode maximum operating temperature of the first heating unit and the first-mode maximum operating temperature of the second heating unit is from 220° C. to 250° C. A lower maximum operating temperature may reduce the amount of undesirable condensate provided in the device in use.

In one embodiment, the second-mode maximum operating temperature of the first heating unit is substantially the same as the second-mode maximum operating temperature of the second heating unit. In another embodiment, the second-mode maximum operating temperature of the first heating unit differs from the second-mode maximum operating temperature of the second heating unit. For example, the second-mode maximum operating temperature of the first heating unit may be higher than the second-mode maximum operating temperature of the second heating unit, or the second-mode maximum operating temperature operating temperature of the first heating unit may be lower than the second-mode maximum operating temperature of the second heating unit. The second-mode maximum operating temperature of the first heating unit may be higher than the second-mode maximum operating temperature of the second unit. The inventors have found that configuring the heating assembly such that the second-mode maximum operating temperature of the first heating unit is substantially the same as the second-mode maximum operating temperature of the second heating unit may reduce the amount of condensate which collects within the device during use, while still providing an acceptable puff to the user.

In some examples, the second-mode maximum operating temperature of the first heating unit and/or the second heating unit is less than 330° C., 320° C., 310° C., 300° C., 290° C., 280° C., 270° C., or 260° C. In some examples, the second-mode maximum operating temperature of the first heating unit and/or the second heating unit is greater than 200° C., 220° C., 230° C., 245° C., 250° C., 255° C., 260° C., 265° C., or 270° C. In some examples, the second-mode maximum operating temperature of the first heating unit and/or the second heating unit is from 250° C. to 300° C., or 260° C. to 290° C. In one embodiment, the second-mode maximum operating temperature of the first heating unit may be from 260° C. to 300° C., or 270° C. to 290° C. In another embodiment, the second-mode maximum operating temperature of the first heating unit may be from 250° C. to 280° C. In one embodiment, the second-mode maximum operating temperature of the second heating unit may be from 240° C. to 280° C., or 250° C. to 270° C. In another embodiment, the second-mode maximum operating temperature of the second heating unit may be from 220° C. to 260° C. A lower maximum operating temperature may reduce the amount of undesirable condensate provided in the device in use. The inventors have identified that a lower maximum operating temperature of the second heating unit may in particular help to reduce the amount of undesirable condensate which collects in the device in use.

In some embodiments, the maximum temperatures of the first and second heating units in the first mode of operation are substantially the same, and the maximum temperature of the first and second heating units in the second mode of operation are substantially the same. Configuring the heating assembly in this manner may further help to reduce the amount of condensate which collects in an external-heating device.

In a further embodiment, the respective maximum temperatures of each heating unit present in the heating assembly are the same in the first mode of operation, and the same in the second mode of operation.

The aerosol-generating device of the present disclosure comprises a first heating unit and optional further heating units, each comprising a heating element. In one embodiment, the or each heating element may be a material that is heatable by penetration with a varying magnetic field. That is, the aerosol-generating material may be heated by induction heating. In this embodiment, the heating unit comprises an inductor (for example, one or more inductor coils), and the device will comprise a component for passing a varying electrical current, such as an alternating current, through the inductor. The varying electric current in the inductor produces a varying magnetic field. When the inductor and the heating element are suitably relatively positioned so that the varying magnetic field produced by the inductor penetrates the heating element, one or more eddy currents are generated inside the heating element. The heating element has a resistance to the flow of electrical currents, so when such eddy currents are generated in the object, their flow against the electrical resistance of the object causes the object to be heated by Joule heating. Supplying a varying magnetic field to a susceptor may conveniently be referred to as supplying energy to a susceptor.

An object that is capable of being inductively heated is known as a susceptor. In cases where the susceptor comprises ferromagnetic material such as iron, nickel or cobalt, heat may also be generated by magnetic hysteresis losses in the susceptor, i.e. by the varying orientation of magnetic dipoles in the magnetic material as a result of their alignment with the varying magnetic field. In inductive heating, as compared to heating by conduction for example, heat is generated inside the susceptor, allowing for rapid heating. Further, there need not be any physical contact between the inductive heater and the susceptor, allowing for enhanced freedom in construction and application.

The heating element may be a susceptor. In embodiments, the susceptor comprises a plurality of heating elements—at least a first induction heating element and a second induction heating element.

In other embodiments, the heating units are not limited to induction heating units. For example, the first heating unit may be an electrical resistance heating unit which may consist of a resistive heating element. The second heating unit may additionally or alternatively be an electrical resistance heating unit which may consist of a resistive heating element. By "resistive heating element", it is meant that on application of a current to the element, resistance in the element transduces electrical energy into thermal energy which heats the aerosol-generating substrate. The heating element may be in the form of a resistive wire, mesh, coil and/or a plurality of wires. The heat source may be a thin-film heater.

The heating element may comprise a metal or metal alloy. Metals are excellent conductors of electricity and thermal energy. Suitable metals include but are not limited to: copper, aluminium, platinum, tungsten, gold, silver, and titanium. Suitable metal alloys include but are not limited to: nichrome and stainless steel.

Another aspect of the present disclosure is an aerosol-generating system comprising an aerosol-generating device as described herein in combination with a smoking article. In an embodiment, the aerosol-generating system comprises a tobacco heating product in combination with a smoking article comprising tobacco. In suitable embodiments the tobacco heating product may comprise the heating assembly and aerosol-generating article described in relation to the figures hereinbelow.

Another aspect of the present disclosure is a method of providing an aerosol with an aerosol-generating device of the present disclosure. The method comprises controlling the or each heating unit in the heating assembly as described herein.

The disclosure will now be described with specific reference to the figures.

FIG. 1 shows an induction heating assembly 100 of an aerosol-generating device according to the present disclosure; FIG. 1B shows a cross section of the induction heating assembly 100 of the device.

The heating assembly 100 has a first or proximal or mouth end 102, and a second or distal end 104. In use, the user will inhale the formed aerosol from the mouth end of the aerosol-generating device. The mouth end may be an open end.

The heating assembly 100 comprises a first induction heating unit 110 and a second induction heating unit 120. The first induction heating unit 110 comprises a first inductor coil 112 and a first heating element 114. The second induction heating unit 120 comprises a second inductor coil 122 and a second heating element 124.

Figure 1A:
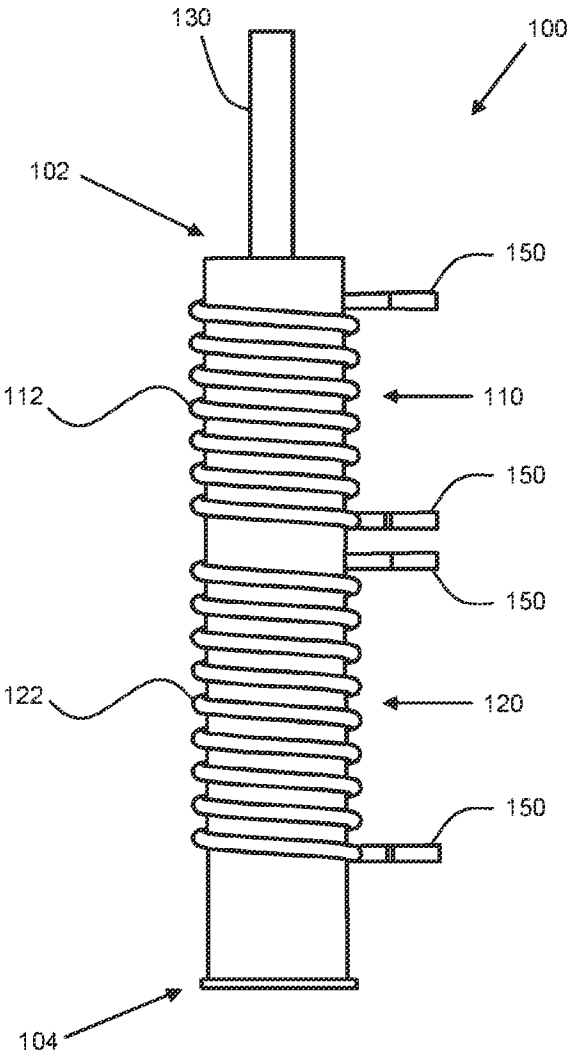
FIG. 1A is a schematic diagram of a heating assembly of an aerosol-generating device according to an embodiment of the present disclosure.

FIGS. 1A and 1B show a smoking article 130 received within a susceptor 140. The susceptor 140 forms the first induction heating element 114 and the second induction heating element 124. The susceptor 140 may be formed from any material suitable for heating by induction. For example, the susceptor 140 may comprise metal. In some embodiments, the susceptor 140 may comprise non-ferrous metal such as copper, nickel, titanium, aluminium, tin, or zinc, and/or ferrous material such as iron, nickel or cobalt. Additionally, or alternatively the susceptor 140 may comprise a semiconductor such as silicon carbide, carbon or graphite.

Each induction heating element present in the aerosol-generating device may have any suitable shape. In the embodiment shown in FIG. 1B, the induction heating elements 114, 124 define a receptacle to surround an aerosol-generating article and heat the aerosol-generating article externally. In other embodiments (not shown), one or more induction heating elements may be substantially elongate, arranged to penetrate an aerosol-generating article and heat the aerosol-generating article internally.

As shown in FIG. 1B, the first induction heating element 114 and second induction heating element 124 may be provided together as a monolithic element 140. That is, in some embodiments, there is no physical distinction between the first 114 and second 124 heating elements. Rather, the differing characteristics between the first and second heating units 110, 120 are defined by separate inductor coils 112, 122 surrounding each induction heating element 114, 124, so that they may be controlled independently from each other. In other embodiments (not depicted), physically distinct inductive heating elements may be employed.

The first and second inductor coils 112, 122 are made from an electrically conducting material. In this example, the first and second inductor coils 112, 122 are made from Litz wire/cable which is wound in a helical fashion to provide helical inductor coils 112, 122. Litz wire comprises a plurality of individual wires which are individually insulated and are twisted together to form a single wire. Litz wires are designed to reduce the skin effect losses in a conductor. In the example induction heating assembly 100, the first and second inductor coils 124, 126 are made from copper Litz wire which has a circular cross section. In other examples the Litz wire can have other shape cross sections, such as rectangular.

The first inductor coil 112 is configured to generate a first varying magnetic field for heating the first induction heating element 114, and the second inductor coil 122 is configured to generate a second varying magnetic field for heating a second section of the susceptor 124. The first inductor coil 112 and the first induction heating element 114 taken together form a first induction heating unit 110. Similarly, the second inductor coil 122 and the second induction heating element 124 taken together form a second induction heating unit 120.

In this example, the first inductor coil 112 is adjacent to the second inductor coil 122 in a direction along the longitudinal axis of the device heating assembly 100 (that is, the first and second inductor coils 112, 122 do not overlap). The susceptor arrangement 140 may comprise a single susceptor. Ends 150 of the first and second inductor coils 112, 122 can be connected to a controller such as a PCB (not shown). In embodiments, the controller comprises a PID controller (proportional integral derivative controller).

The varying magnetic field generates eddy currents within the first inductive heating element 114, thereby rapidly heating the first induction heating element 114 to a maximum operating temperature within a short period of time from supplying the alternative current to the coil 112, for example within 20, 15, 12, 10, 5, or 2 seconds. Arranging the first induction heating unit 110 which is configured to rapidly reach a maximum operating temperature closer to the mouth end 102 of the heating assembly 100 than the second induction heating unit 120 may mean that an acceptable aerosol is provided to a user as soon as possible after initiation of a session of use.

It will be appreciated that the first and second inductor coils 112, 122, in some examples, may have at least one characteristic different from each other. For example, the first inductor coil 112 may have at least one characteristic different from the second inductor coil 122. More specifically, in one example, the first inductor coil 112 may have a different value of inductance than the second inductor coil 122. In FIGS. 1A and 1B, the first and second inductor coils 112, 122 are of different lengths such that the first inductor coil 112 is wound over a smaller section of the susceptor 140 than the second inductor coil 122. Thus, the first inductor coil 112 may comprise a different number of turns than the second inductor coil 122 (assuming that the spacing between individual turns is substantially the same). In yet another example, the first inductor coil 112 may be made from a different material to the second inductor coil 122. In some examples, the first and second inductor coils 112, 122 may be substantially identical.

In this example, the first inductor coil 112 and the second inductor coil 122 are wound in the same direction. However, in another embodiment, the inductor coils 112, 122 may be wound in opposite directions. This can be useful when the inductor coils are active at different times. For example, initially, the first inductor coil 112 may be operating to heat the first induction heating element 114, and at a later time, the second inductor coil 122 may be operating to heat the second induction heating element 124. Winding the coils in opposite directions helps reduce the current induced in the inactive coil when used in conjunction with a particular type of control circuit. In one example, the first inductor coil 112 may be a right-hand helix and the second inductor coil 122 a left-hand helix. In another example, the first inductor coil 112 may be a left-hand helix and the second inductor coil 122 may be a right-hand helix.

The coils 112, 122 may have any suitable geometry. Without wishing to be bound by theory, configuring an induction heating element to be smaller (e.g. smaller pitch helix; fewer revolutions in the helix; shorter overall length of the helix), may increase the rate at which the induction heating element can reach a maximum operating temperature. In some embodiments, the first coil 112 may have a length of less than approximately 20 mm, less than 18 mm, less than 16 mm, or a length of approximately 14 mm, in the longitudinal direction of the heating assembly 100. The first coil 112 may have a length shorter than the second coil 124 in the longitudinal direction of the heating assembly 100. Such an arrangement may provide asymmetrical heating of the aerosol-generating article along the length of the aerosol-generating article.

The susceptor 140 of this example is hollow and therefore defines a receptacle within which aerosol-generating material is received. For example, the article 130 can be inserted into the susceptor 140. In this example the susceptor 140 is tubular, with a circular cross section.

The induction heating elements 114 and 124 are arranged to surround the smoking article 130 and heat the smoking article 130 externally. The aerosol-generating device is configured such that, when the smoking article 130 is received within the susceptor 140, the outer surface of the article 130 abuts the inner surface of the susceptor 140. This ensures that the heating is most efficient. The article 130 of this example comprises aerosol-generating material. The aerosol-generating material is positioned within the susceptor 140. The article 130 may also comprise other components such as a filter, wrapping materials and/or a cooling structure.

The heating assembly 100 is not limited to two heating units. In some examples, the heating assembly 100 may comprise three, four, five, six, or more than six heating units. These heating units may each be controllable independent from the other heating units present in the heating assembly 100.

Figure 2A:
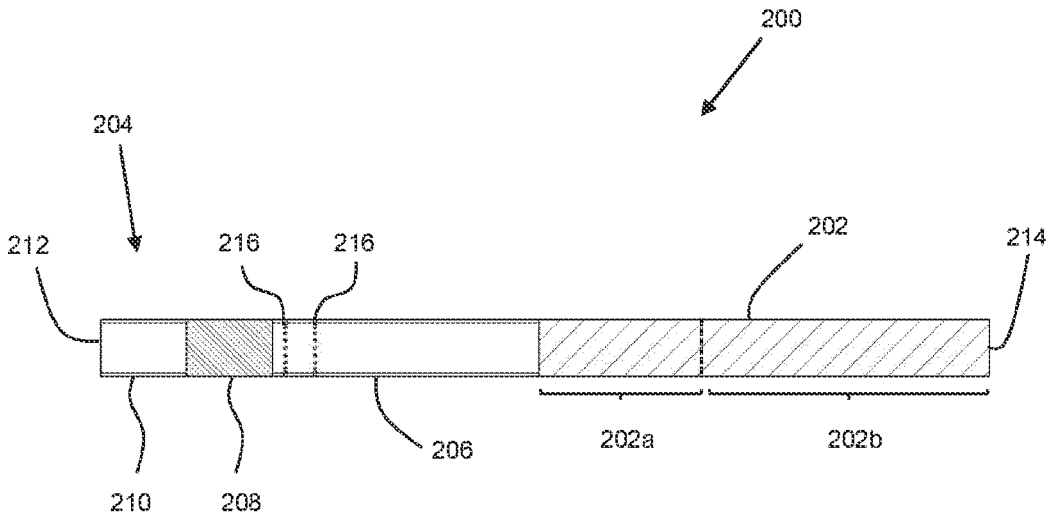
FIG. 2A is a schematic cross-section of an aerosol-generating article for use with the aerosol-generating device of the present disclosure.
Figure 2B:
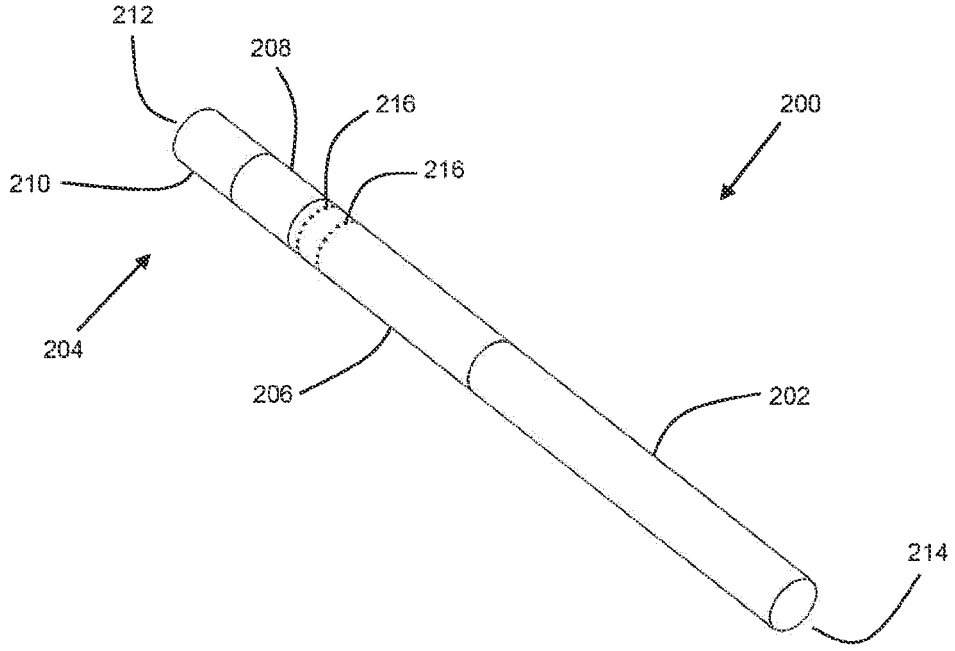
FIG. 2B is a perspective view of the aerosol-generating article.

Referring to FIGS. 2A and 2B, there is shown a partially cut-away section view and a perspective view of an example of an aerosol-generating article 200. The aerosol-generating article 200 shown in FIGS. 2A and 2B corresponds to the aerosol-generating article 130 shown in FIG. 1.

The aerosol-generating article 200 may be any shape suitable for use with an aerosol-generating device. The smoking article 130 may be in the form of or provided as part of a cartridge or cassette or rod which can be inserted into the apparatus. In the embodiment shown in FIGS. 1A and 1B and 2, the smoking article 130 is in the form of a substantially cylindrical rod that includes a body of smokable material 202 and a filter assembly 204 in the form of a rod. The filter assembly 204 includes three segments, a cooling segment 206, a filter segment 208 and a mouth end segment 210. The article 200 has a first end 212, also known as a mouth end or a proximal end and a second end 214, also known as a distal end. The body of aerosol-generating material 202 is located towards the distal end 214 of the article 200. In one example, the cooling segment 206 is located adjacent the body of aerosol-generating material 202 between the body of aerosol-generating material 202 and the filter segment 208, such that the cooling segment 206 is in an abutting relationship with the aerosol-generating material 202 and the filter segment 208. In other examples, there may be a separation between the body of aerosol-generating material 202 and the cooling segment 206 and between the body of aerosol-generating material 202 and the filter segment 208. The filter segment 208 is located in between the cooling segment 206 and the mouth end segment 210. The mouth end segment 210 is located towards the proximal end 212 of the article 200, adjacent the filter segment 208. In one example, the filter segment 208 is in an abutting relationship with the mouth end segment 210. In one embodiment, the total length of the filter assembly 204 is between 37 mm and 45 mm, or the total length of the filter assembly 204 is 41 mm.

In use, portions 202*a* and 202*b* of the body of aerosol-generating material 202 may correspond to the first induction heating element 114 and second induction heating element 124 of the portion 100 shown in FIG. 1B respectively.

The body of smokable material may have a plurality of portions 202*a*, 202*b* which correspond to the plurality of induction heating elements present in the aerosol-generating device. For example, the aerosol-generating article 200 may have a first portion 202*a* which corresponds to the first induction heating element 114 and a second portion 202*b* which corresponds to the second induction heating element 124. These portions 202*a*, 202*b* may exhibit temperature profiles which are different from each other during a session of use; the temperature profiles of the portions 202*a*, 202*b* may derive from the temperature profiles of the first induction heating element 114 and second induction heating element 124 respectively.

Where there is a plurality of portions 202*a*, 202*b* of a body of aerosol-generating material 202, any number of the substrate portions 202*a*, 202*b* may have substantially the same composition. In a particular example, all of the portions 202*a*, 202*b* of the substrate have substantially the same composition. In one embodiment, body of aerosol-generating material 202 is a unitary, continuous body and there is no physical separation between the first and second portions 202*a*, 202*b*, and the first and second portions have substantially the same composition.

In one embodiment, the body of aerosol-generating material 202 comprises tobacco. However, in other respective embodiments, the body of smokable material 202 may consist of tobacco, may consist substantially entirely of tobacco, may comprise tobacco and aerosol-generating material other than tobacco, may comprise aerosol-generating material other than tobacco, or may be free of tobacco. The aerosol-generating material may include an aerosol generating agent, such as glycerol.

In a particular embodiment, the aerosol-generating material may comprise one or more tobacco components, filler components, binders and aerosol generating agents.

The filler component may be any suitable inorganic filler material. Suitable inorganic filler materials include, but are not limited to: calcium carbonate (i.e. chalk), perlite, vermiculite, diatomaceous earth, colloidal silica, magnesium oxide, magnesium sulphate, magnesium carbonate, and suitable inorganic sorbents, such as molecular sieves. Calcium carbonate is particularly suitable. In some cases, the filler comprises an organic material such as wood pulp, cellulose and cellulose derivatives.

The binder may be any suitable binder. In some embodiments, the binder comprises one or more of an alginate, celluloses or modified celluloses, polysaccharides, starches or modified starches, and natural gums.

Suitable binders include, but are not limited to: alginate salts comprising any suitable cation, such as sodium alginate, calcium alginate, and potassium alginate; celluloses or modified celluloses, such as hydroxypropyl cellulose and carboxymethylcellulose; starches or modified starches; polysaccharides such as pectin salts comprising any suitable cation, such as sodium, potassium, calcium or magnesium pectate; xanthan gum, guar gum, and any other suitable natural gums.

A binder may be included in the aerosol-generating material in any suitable quantity and concentration.

The "aerosol-generating agent" is an agent that promotes the generation of an aerosol. An aerosol-generating agent may promote the generation of an aerosol by promoting an initial vaporisation and/or the condensation of a gas to an inhalable solid and/or liquid aerosol. In some embodiments, an aerosol-generating agent may improve the delivery of flavor from the smoking article.

In general, any suitable aerosol-generating agent or agents may be included in the aerosol-generating material. Suitable aerosol-generating agent include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate.

In a particular embodiment, the aerosol-generating material comprises a tobacco component in an amount of from 60 to 90% by weight of the tobacco composition, a filler component in an amount of 0 to 20% by weight of the tobacco composition, and an aerosol generating agent in an amount of from 10 to 20% by weight of the tobacco composition. The tobacco component may comprise paper reconstituted tobacco in an amount of from 70 to 100% by weight of the tobacco component.

In one example, the body of aerosol-generating material 202 is between 34 mm and 50 mm in length, or the body of aerosol-generating material 202 is between 38 mm and 46 mm in length, or the body of aerosol-generating material 202 is 42 mm in length.

In one example, the total length of the article 200 is between 71 mm and 95 mm, or total length of the article 200 is between 79 mm and 87 mm, or total length of the article 200 is 83 mm.

An axial end of the body of aerosol-generating material 202 is visible at the distal end 214 of the article 200. However, in other embodiments, the distal end 214 of the article 200 may comprise an end member (not shown) covering the axial end of the body of aerosol-generating material 202.

The body of aerosol-generating material 202 is joined to the filter assembly 204 by annular tipping paper (not shown), which is located substantially around the circumference of the filter assembly 204 to surround the filter assembly 204 and extends partially along the length of the body of aerosol-generating material 202. In one example, the tipping paper is made of 58GSM standard tipping base paper. In one example has a length of between 42 mm and 50 mm, or the tipping paper has a length of 46 mm.

In one example, the cooling segment 206 is an annular tube and is located around and defines an air gap within the cooling segment. The air gap provides a chamber for heated volatilized components generated from the body of aerosol-generating material 202 to flow. The cooling segment 206 is hollow to provide a chamber for aerosol accumulation yet rigid enough to withstand axial compressive forces and bending moments that might arise during manufacture and whilst the article 200 is in use during insertion into the device 100. In one example, the thickness of the wall of the cooling segment 206 is approximately 0.29 mm.

The cooling segment 206 provides a physical displacement between the aerosol-generating material 202 and the filter segment 208. The physical displacement provided by the cooling segment 206 will provide a thermal gradient across the length of the cooling segment 206. In one example the cooling segment 206 is configured to provide a temperature differential of at least 40° C. between a heated volatilized component entering a first end of the cooling segment 206 and a heated volatilized component exiting a second end of the cooling segment 206. In one example the cooling segment 206 is configured to provide a temperature differential of at least 60° C. between a heated volatilized component entering a first end of the cooling segment 206 and a heated volatilized component exiting a second end of the cooling segment 206. This temperature differential across the length of the cooling element 206 protects the temperature sensitive filter segment 208 from the high temperatures of the aerosol-generating material 202 when it is heated by the heating assembly 100 of the device aerosol-generating device. If the physical displacement was not provided between the filter segment 208 and the body of aerosol-generating material 202 and the heating elements 114, 124 of the heating assembly 100, then the temperature sensitive filter segment 208 may become damaged in use, so it would not perform its required functions as effectively.

In one example the length of the cooling segment 206 is at least 15 mm. In one example, the length of the cooling segment 206 is between 20 mm and 30 mm, more particularly 23 mm to 27 mm, more particularly 25 mm to 27 mm and more particularly 25 mm.

The cooling segment 206 is made of paper, which means that it is comprised of a material that does not generate compounds of concern, for example, toxic compounds when in use adjacent to the heater assembly 100 of the aerosol-generating device. In one example, the cooling segment 206 is manufactured from a spirally wound paper tube which provides a hollow internal chamber yet maintains mechanical rigidity. Spirally wound paper tubes are able to meet the tight dimensional accuracy requirements of high-speed manufacturing processes with respect to tube length, outer diameter, roundness and straightness.

In another example, the cooling segment 206 is a recess created from stiff plug wrap or tipping paper. The stiff plug wrap or tipping paper is manufactured to have a rigidity that is sufficient to withstand the axial compressive forces and bending moments that might arise during manufacture and whilst the article 200 is in use during insertion into the device 100.

For each of the examples of the cooling segment 206, the dimensional accuracy of the cooling segment is sufficient to meet the dimensional accuracy requirements of high-speed manufacturing process.

The filter segment 208 may be formed of any filter material sufficient to remove one or more volatilized compounds from heated volatilized components from the smokable material. In one example the filter segment 208 is made of a mono-acetate material, such as cellulose acetate. The filter segment 208 provides cooling and irritation-reduction from the heated volatilized components without depleting the quantity of the heated volatilized components to an unsatisfactory level for a user.

The density of the cellulose acetate tow material of the filter segment 208 controls the pressure drop across the filter segment 208, which in turn controls the draw resistance of the article 200. Therefore the selection of the material of the filter segment 208 is important in controlling the resistance to draw of the article 200. In addition, the filter segment 208 performs a filtration function in the article 200.

In one example, the filter segment 208 is made of a 8Y15 grade of filter tow material, which provides a filtration effect on the heated volatilized material, whilst also reducing the size of condensed aerosol droplets which result from the heated volatilized material which consequentially reduces the irritation and throat impact of the heated volatilized material to satisfactory levels.

The presence of the filter segment 208 provides an insulating effect by providing further cooling to the heated volatilized components that exit the cooling segment 206. This further cooling effect reduces the contact temperature of the user's lips on the surface of the filter segment 208.

One or more flavor may be added to the filter segment 208 in the form of either direct injection of flavored liquids into the filter segment 208 or by embedding or arranging one or more flavored breakable capsules or other flavor carriers within the cellulose acetate tow of the filter segment 208.

In one example, the filter segment 208 is between 6 mm to 10 mm in length, or 8 mm.

The mouth end segment 210 is an annular tube and is located around and defines an air gap within the mouth end segment 210. The air gap provides a chamber for heated volatilized components that flow from the filter segment 208. The mouth end segment 210 is hollow to provide a chamber for aerosol accumulation yet rigid enough to withstand axial compressive forces and bending moments that might arise during manufacture and whilst the article is in use during insertion into the device 100. In one example, the thickness of the wall of the mouth end segment 210 is approximately 0.29 mm.

In one example, the length of the mouth end segment 210 is between 6 mm to 10 mm or 8 mm. In one example, the thickness of the mouth end segment is 0.29 mm.

The mouth end segment 210 may be manufactured from a spirally wound paper tube which provides a hollow internal chamber yet maintains critical mechanical rigidity. Spirally wound paper tubes are able to meet the tight dimensional accuracy requirements of high-speed manufacturing processes with respect to tube length, outer diameter, roundness and straightness.

The mouth end segment 210 provides the function of preventing any liquid condensate that accumulates at the exit of the filter segment 208 from coming into direct contact with a user.

It should be appreciated that, in one example, the mouth end segment 210 and the cooling segment 206 may be formed of a single tube and the filter segment 208 is located within that tube separating the mouth end segment 210 and the cooling segment 206.

A ventilation region 216 is provided in the article 200 to enable air to flow into the interior of the article 200 from the exterior of the article 200. In one example the ventilation region 216 takes the form of one or more ventilation holes 216 formed through the outer layer of the article 200. The ventilation holes may be located in the cooling segment 206 to aid with the cooling of the article 200. In one example, the ventilation region 216 comprises one or more rows of holes, or each row of holes is arranged circumferentially around the article 200 in a cross-section that is substantially perpendicular to a longitudinal axis of the article 200.

In one example, there are between one to four rows of ventilation holes to provide ventilation for the article 200. Each row of ventilation holes may have between 12 to 36 ventilation holes 216. The ventilation holes 216 may, for example, be between 100 to 500 μm in diameter. In one example, an axial separation between rows of ventilation holes 216 is between 0.25 mm and 0.75 mm, or an axial separation between rows of ventilation holes 216 is 0.5 mm.

In one example, the ventilation holes 216 are of uniform size. In another example, the ventilation holes 216 vary in size. The ventilation holes can be made using any suitable technique, for example, one or more of the following techniques: laser technology, mechanical perforation of the cooling segment 206 or pre-perforation of the cooling segment 206 before it is formed into the article 200. The ventilation holes 216 are positioned so as to provide effective cooling to the article 200.

In one example, the rows of ventilation holes 216 are located at least 11 mm from the proximal end 212 of the article, or the ventilation holes are located between 17 mm and 20 mm from the proximal end 212 of the article 200. The location of the ventilation holes 216 is positioned such that user does not block the ventilation holes 216 when the article 200 is in use.

Advantageously, providing the rows of ventilation holes between 17 mm and 20 mm from the proximal end 212 of the article 200 enables the ventilation holes 216 to be located outside of the device 100, when the article 200 is fully inserted in the device 100, as can be seen in FIG. 1. By locating the ventilation holes outside of the apparatus, non-heated air is able to enter the article 200 through the ventilation holes from outside the device 100 to aid with the cooling of the article 200.

The length of the cooling segment 206 is such that the cooling segment 206 will be partially inserted into the device 100, when the article 200 is fully inserted into the device 100. The length of the cooling segment 206 provides a first function of providing a physical gap between the heater arrangement of the device 100 and the heat sensitive filter arrangement 208, and a second function of enabling the ventilation holes 216 to be located in the cooling segment, whilst also being located outside of the device 100, when the article 200 is fully inserted into the device 100. As can be seen from FIG. 1, the majority of the cooling element 206 is located within the device 100. However, there is a portion of the cooling element 206 that extends out of the device 100. It is in this portion of the cooling element 206 that extends out of the device 100 in which the ventilation holes 216 are located.

Figure 3:
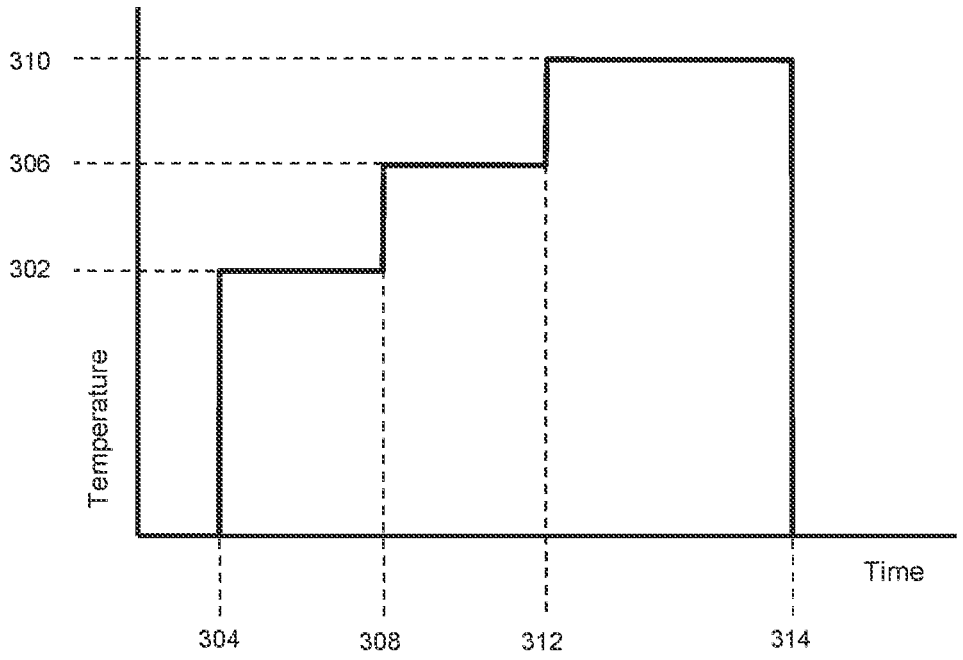
FIG. 3 is a graph showing a general programmed heating profile of a heating element in an aerosol-generating device according to an example of the present disclosure during an exemplary session of use.

FIG. 3 depicts a programmed temperature profile 300 of a heating unit in an aerosol-generating device during an exemplary session of use 302. The temperature profile 300 suitably refers to a stepwise heating profile of any heating unit in any mode of operation of the heating assembly.

A programmed heating profile 300 includes a first temperature 302 that is the first temperature which the heating unit is programmed to reach during a given session of use at a first timepoint 304. The first timepoint 304 may conveniently be defined in terms of the number of seconds elapsed from the start of a session of use, i.e., from the point at which power is first supplied to at least one heating unit present in the heating assembly.

The programmed heating profile 300 includes a second temperature 306 different from the first temperature 302. The heating unit is programmed to reach the second temperature 306 during a given session of use at the second timepoint 308. The second timepoint 308 occurs temporally after the first timepoint 304.

From the first timepoint 304 to the second timepoint 308, the heating unit is programmed to have substantially the same temperature: the heating unit is held at the first temperature 302. In one embodiment, the second temperature 306 is higher than the first temperature 302.

The programmed heating profile 300 includes a third temperature 310 different from the second temperature. The heating unit is programmed to reach to the third temperature 310 during a given session of use at the third timepoint 312. The third timepoint 312 occurs temporally after the second timepoint 308 and thus the first timepoint 302. In one embodiment, the third temperature 310 is higher than the second temperature 306.

The programmed heating profile 300 includes a final timepoint 314, the point at which energy stops being supplied to the heating unit for the rest of the session of use. It may be that the final timepoint 314 is concurrent with the end of the session of use.

EXAMPLES

Reference Example

Figure 4:
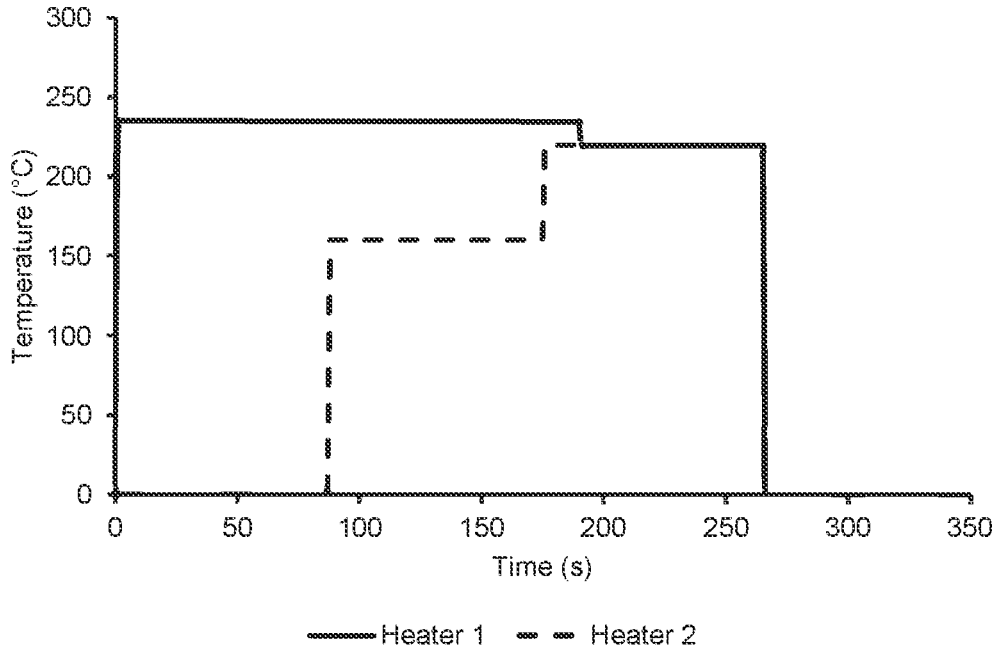
FIG. 4 is a graph showing programmed heating profiles of first and second induction heating elements in a reference example.

FIG. 4 shows the programmed heating profiles of a first heating unit 110 (solid line) and second heating unit 120 (dashed line) in a heating assembly 100 as shown in FIG. 1 to be operated in a first mode of operation.

The heating assembly 100 was programmed such that the first heating unit 110 should reach a maximum operating temperature of 235° C. as quickly as possible. The heating assembly 100 was programmed such that the first heating unit 110 would remain at a temperature of 235° C. for the first 190 seconds of the session of use, then drop to a temperature of 220° C. for the remainder of the session of use.

The heating assembly 100 was programmed such that the second heating unit 120 would reach a first temperature of 160° C. approximately 87 seconds after the start of the session of use. The heating assembly 100 was programmed such that the second heating unit 120 would subsequently rise to a maximum heating temperature of 220° C. approximately 175 seconds after the start of the session of use, and remain at that temperature until the end of the session of use, 265 seconds after the start of the session of use.

A device configured as described hereinabove was used to carry out a Standard Condensation Experiment to determine the amount of condensate which collected inside the device.

Standard Condensation Experiment

The mass of the device was measured before running a session of use. The session of use was then run twelve times without emptying the device of condensate. A new tobacco rod was provided in the device for each session of use.

The mass of the device was measured after four, eight and twelve sessions of use. At each stage, the mass was measured directly after the session of use had ended, and also after a rest period of approximately 25 minutes from the end of the session of use.

After 12 runs, the mass of the device was measured. The mass of the device before running the experiment was subtracted from the mass of the device after running the experiment to provide the mass of the condensate which had collected in the device over twelve sessions of use. The experiment was carried out in duplicate.

The results of the standard condensation experiment for Reference Example 1 are shown in Table 1.

TABLE 1

| | Mass of condensate (mg) | | |
|---|---|---|---|
| Time Point | Replicate 1 | Replicate 2 | Average |
| 0 sessions | 0.0000 | 0.0000 | 0.0000 |
| 4 sessions | 0.0205 | 0.0261 | 0.0233 |
| 4 sessions + rest period | 0.0220 | 0.0271 | 0.0245 |
| 8 sessions | 0.0388 | 0.0440 | 0.0414 |
| 8 sessions + rest period | 0.0398 | 0.0447 | 0.0423 |
| 12 sessions | 0.0582 | 0.0607 | 0.0595 |
| 12 sessions + rest period | 0.0601 | 0.0620 | 0.0611 |

The average total mass of condensate retained in the device after twelve sessions of use was approximately 61 mg.

Example

Figure 5:
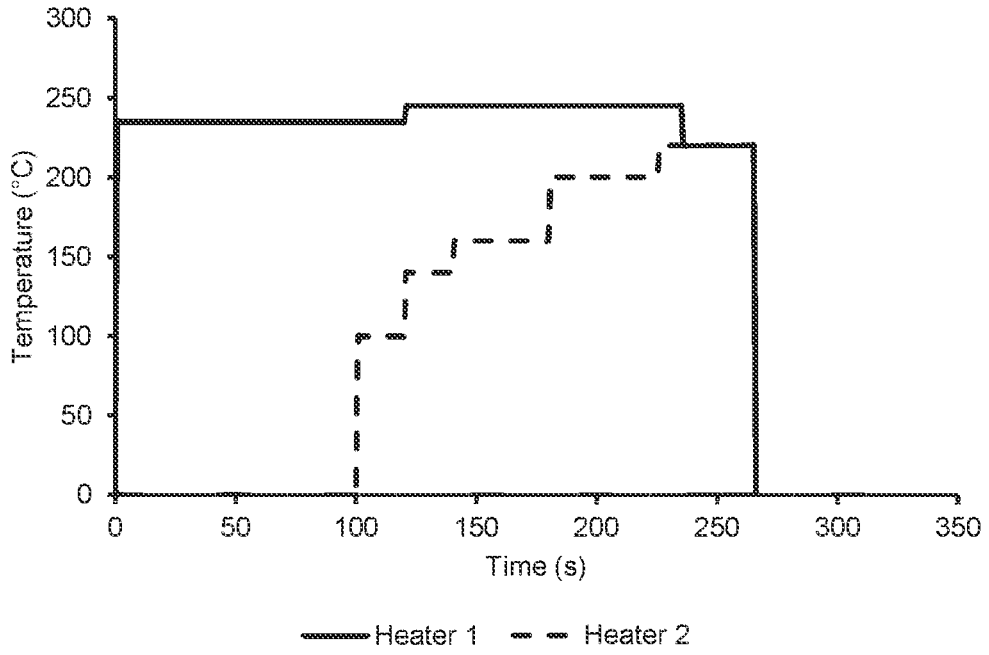
FIG. 5 is a graph showing programmed heating profiles of first and second induction heating elements in an example of the present disclosure.

FIG. 5 shows the programmed heating profiles of a first heating unit 110 (solid line) and second heating unit 120 (dashed line) in a heating assembly 100 as shown in FIG. 1 to be operated in another first mode of operation.

The heating assembly 100 was programmed such that the first heating unit 110 should reach a first operating temperature of 235° C. as quickly as possible. The heating assembly 100 was programmed such that the first heating unit 110 would remain at a temperature of 235° C. for the first 120 seconds of the session of use, then rise to a maximum operating temperature of 245° C. until 225 seconds had elapsed from the start of the session of use, then drop to a temperature of 220° C. for the remainder of the session of use.

The heating assembly 100 was programmed such that the second heating unit 120 would:

a) reach a first temperature of 100° C. approximately 100 seconds after the start of the session of use; then
b) rise to a second temperature of 140° C. approximately 120 seconds after the start of the session of use; then
c) rise to a third temperature of 160° C. approximately 140 seconds after the start of the session of use; then
d) rise to a fourth temperature of 200° C. approximately 180 seconds after the start of the session of use; then
e) rise to a fifth, maximum operating temperature of 220° C. approximately 225 seconds after the start of the session of use, and remain at that temperature until the end of the session of use, 265 seconds after the start of the session of use.

A device configured as described hereinabove was analysed according to the Standard Condensation Experiment set out in the Reference Example. The results of the Experiment are shown in Table 2:

TABLE 2

| Time Point | Mass of condensate (mg) | | |
|---|---|---|---|
| | Replicate 1 | Replicate 2 | Average |
| 0 sessions | 0.0000 | 0.0000 | 0.0000 |
| 4 sessions | 0.0182 | 0.0184 | 0.0183 |
| 4 sessions + rest period | 0.0195 | 0.0202 | 0.0198 |
| 8 sessions | 0.0338 | 0.0356 | 0.0347 |
| 8 sessions + rest period | 0.0348 | 0.0368 | 0.0358 |
| 12 sessions | 0.0486 | 0.0496 | 0.0491 |
| 12 sessions + rest period | 0.0501 | 0.0508 | 0.0504 |

The average total mass of condensate retained in the device after twelve sessions of use was approximately 50 mg. This represents a condensate reduction of more than 18% compared with the Reference Example.

The above embodiments are to be understood as illustrative examples of the disclosure. Further embodiments of the disclosure are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the disclosure.

The invention claimed is:

1. An aerosol-generating device for generating aerosol from an aerosol-generating material, the aerosol-generating device comprising:

a heating assembly including:

one or more heating units arranged to heat, but not burn, the aerosol-generating material in use; and a controller for controlling the one or more heating units;

wherein the controller is programmed such that, during a session of use, at least one of the one or more heating units is powered so as to be heated to a plurality of different temperatures sequentially, and each time that the at least one of the one or more heating units is heated to a new temperature which is higher than a previous temperature:

the new temperature is less than 120° C. greater than the previous temperature; and the at least one of the one or more heating units is held at the new temperature for at least 0.5 seconds; and wherein the plurality of different temperatures includes a first temperature to which the at least one of the one or more heating units is heated and held for at least 0.5 seconds, wherein the first temperature is less than 120° C.

2. The aerosol-generating device of claim 1, wherein each time that the at least one of the one or more heating units is heated to a new temperature which is higher than a previous temperature: when the previous temperature is equal to or greater than 80° C., the new temperature is less than 70° C. higher than the previous temperature.

3. The aerosol-generating device of claim 1, wherein the plurality of different temperatures comprises at least three different temperatures.

4. The aerosol-generating device of claim 3, wherein the at least three different temperatures includes a first temperature, a second temperature which the at least one of the one or more heating units reaches after being held at the first temperature, and a third temperature which the at least one of the one or more heating units the heating unit reaches after being held at the second temperature, wherein the second temperature is higher than the first temperature.

5. The aerosol-generating device of claim 4, wherein the second temperature is less than 60° C. greater than the first temperature.

6. The aerosol-generating device of claim 4, wherein the third temperature is higher than the second temperature.

7. The aerosol-generating device of claim 6, wherein the third temperature is less than 60° C. greater than the second temperature.

8. The aerosol-generating device of claim 4, wherein the first temperature is from 40° C. to 130° C.

9. The aerosol-generating device of claim 1, wherein each time the at least one of the one or more heating units is heated to the new temperature, the new temperature is greater than the previous temperature, until the at least one of the one or more heating units reaches its maximum operating temperature.

10. The aerosol-generating device of claim 1, wherein the one or more heating units comprises a first heating unit and a second heating unit.

11. The aerosol-generating device of claim 10, wherein the heating assembly has a mouth end and a distal end, the first heating unit is disposed closer to the mouth end than the second heating unit, and the at least one of the one or more heating units comprises the second heating unit.

12. The aerosol-generating device of claim 10, wherein the heating assembly is configured such that the first heating unit reaches a temperature of from 200° C. to 300° C. within 20 seconds of starting a session of use.

13. The aerosol-generating device of claim 11, wherein the heating assembly is configured such that the second heating unit is heated to a temperature equal to or greater than 80° C. but not before 20 seconds from the start of a session of use.

14. The aerosol-generating device of claim 1, wherein each heating unit of the heating assembly comprises a coil.

15. The aerosol-generating device of claim 14, wherein each heating unit of the heating assembly is an induction heating unit comprising a coil configured to be an inductor element for supplying a varying magnetic field to a susceptor heating element.

16. The aerosol-generating device of claim 1, wherein each heating unit of the heating assembly is a resistive heating unit.

17. The aerosol-generating device of claim 1, wherein the aerosol-generating device is a tobacco heating product.

18. An aerosol-generating system comprising the aerosol-generating device of claim 1 in combination with an aerosol-generating article, wherein the aerosol-generating article comprises the aerosol-generating material.

19. An aerosol-generating device for generating aerosol from an aerosol-generating material, the aerosol-generating device comprising:

a heating assembly including one or more heating units arranged to heat, but not burn, the aerosol-generating material in use; and a controller for controlling the one or more heating units;

wherein the controller is programmed such that, during a session of use, at least one of the one or more heating units is sequentially heated to at least three different temperatures and is held at each of the at least three different temperatures for at least 0.5 seconds; and wherein the at least three different temperatures include a first temperature to which the at least one of the one or more heating units is heated and held for at least 0.5 seconds, wherein the first temperature is less than 120° C.

20. The aerosol-generating device of claim 19, wherein the at least three different temperatures includes a second temperature which the heating unit reaches after being held at the first temperature, and a third temperature which the heating unit reaches after being held at the second temperature, wherein the second temperature is higher than the first temperature, and wherein the third temperature is higher than the second temperature.

21. A method of generating aerosol from an aerosol-generating material using an aerosol-generating device comprising:

a heating assembly including:

one or more heating units arranged to heat, but not burn, the aerosol-generating material in use; and a controller for controlling the one or more heating units;

the method comprising instructing at least one of the one or more heating units of the device heating unit to:

reach a plurality of different temperatures sequentially, wherein each time a new temperature is higher than a previous temperature, the new temperature is less than 120° C. greater than the previous temperature; and hold the new temperature for at least 0.5 seconds;

wherein the plurality of different temperatures includes a first temperature to which the at least one of the one or more heating units is heated and held for at least 0.5 seconds, wherein the first temperature is less than 120° C.

* * * * *